US005490563A

United States Patent [19]

Wesson et al.

[11] Patent Number: 5,490,563

[45] Date of Patent: Feb. 13, 1996

[54] PERFORATING GUN ACTUATOR

[75] Inventors: David Wesson, Ike; Kevin R. George, Cleburne; Flint R. George, Flower Mound, all of Tex.

[73] Assignee: Halliburton Company, Houston, Tex.

[21] Appl. No.: 343,747

[22] Filed: Nov. 22, 1994

[51] Int. Cl.[6] ..... E21B 29/00; E21B 43/11

[52] U.S. Cl. ..... 166/297; 166/299; 175/4.56

[58] Field of Search ..... 166/55.1, 297, 166/299; 175/4.52, 4.54, 4.56

[56] References Cited

U.S. PATENT DOCUMENTS

| | | | |
|---|---|---|---|
| B13,706,344 | 7/1985 | Vann | 166/297 |
| 4,509,604 | 4/1985 | Upchurch | 175/4.52 |
| 4,560,000 | 12/1985 | Upchurch | 166/55.1 |
| 4,614,156 | 9/1986 | Colle, Jr. et al. | 102/312 |
| 4,616,718 | 10/1986 | Gambertoglio | 175/4.54 |
| 4,886,126 | 12/1989 | Yates, Jr. | 166/297 |
| 4,898,244 | 2/1990 | Schneider et al. | 166/297 |
| 4,901,802 | 2/1990 | George et al. | 166/297 |
| 4,924,952 | 5/1990 | Schneider | 175/4.54 |
| 4,969,525 | 11/1990 | George et al. | 166/297 |
| 5,101,907 | 4/1992 | Schultz et al. | 166/386 |
| 5,103,906 | 4/1992 | Schultz et al. | 166/264 |
| 5,167,282 | 12/1992 | Schneider et al. | 166/297 |
| 5,238,070 | 8/1993 | Schultz et al. | 166/386 |
| 5,279,363 | 1/1994 | Schultz et al. | 166/53 |
| 5,301,755 | 4/1994 | George et al. | 166/297 |

*Primary Examiner*—Frank S. Tsay

*Attorney, Agent, or Firm*—Shawn Hunter; William M. Imwalle

[57] ABSTRACT

An actuating tool which is conveyed into a tubing string to attach to portions of an emplaced perforating gun. The tool includes an actuator with an electronic delay timer and an explosive device. The tool attaches to an emplaced perforating gun and detonates it by initiating an explosive charge along a complete explosive pathway formed between the actuator and gun, the actuator includes a tandem piston arrangement functional at most existing hydrostatic pressure levels, but nonfunctional at or near the surface of the wellbore. The tool may be withdrawn from the tubing string for a backup detonation tool to be placed into the tubing string to detonate a secondary firing head.

18 Claims, 6 Drawing Sheets

108
106
110
114
104
102,112
116
100
118
122
122
120
102,112
124
130
102,128
126
136
137
132
134
134
139
102,138
102,138
140
144
165
102,146
167
162
150
158
156
160
160
166
148
148
152
171
168
170
172
176
180
182
174
186
188
190
102,184

Fig. 2D
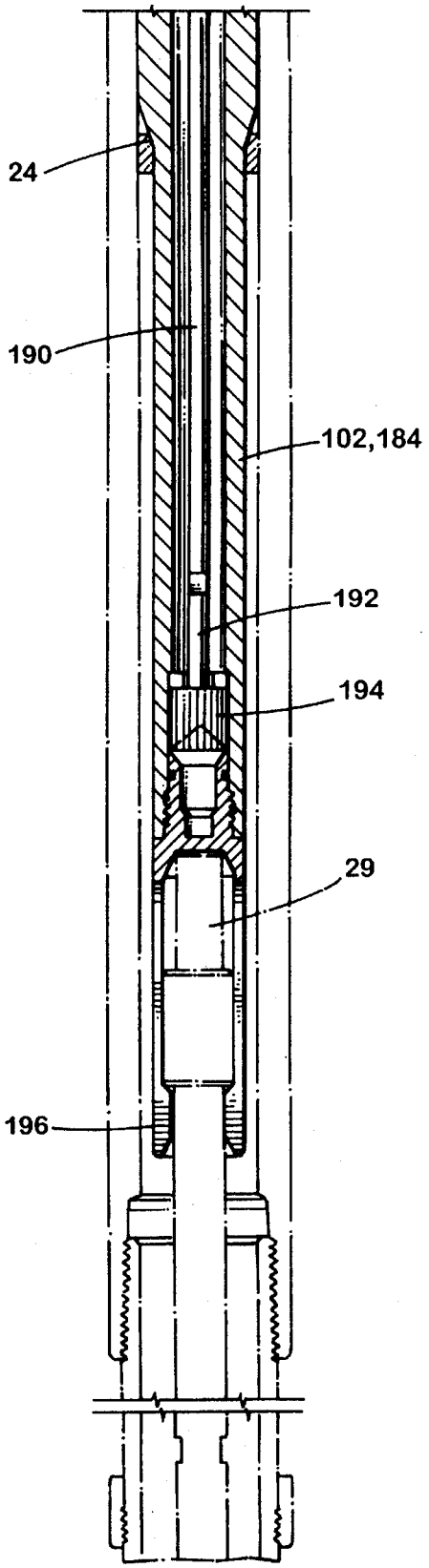
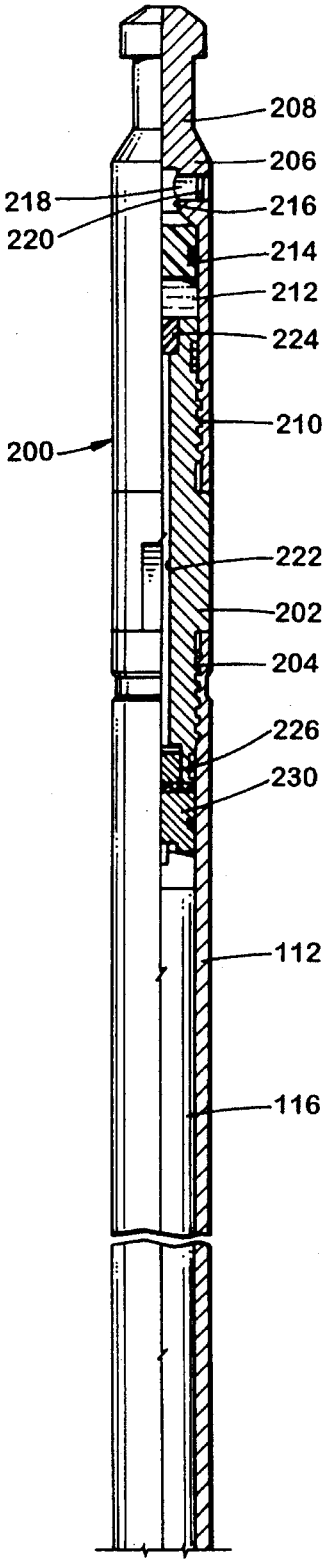
Fig. 8

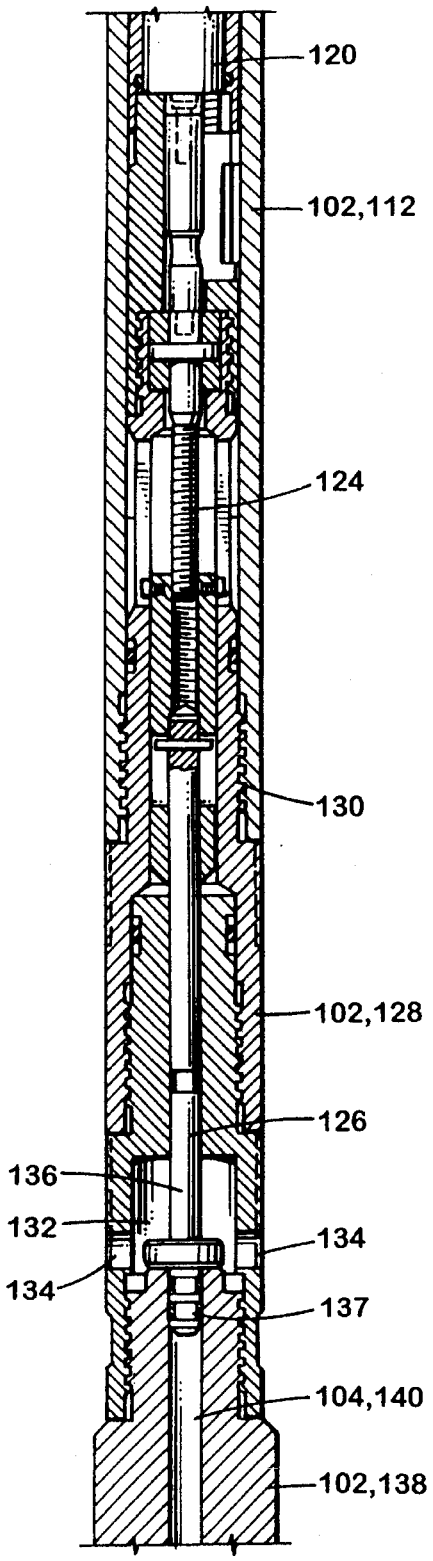
Fig. 3A
Fig. 3B
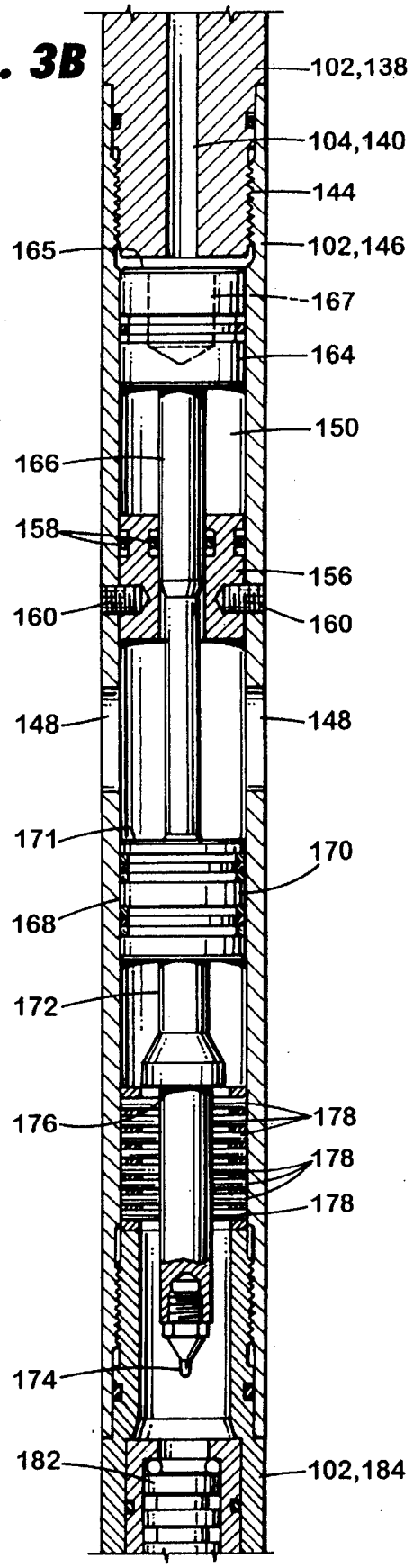

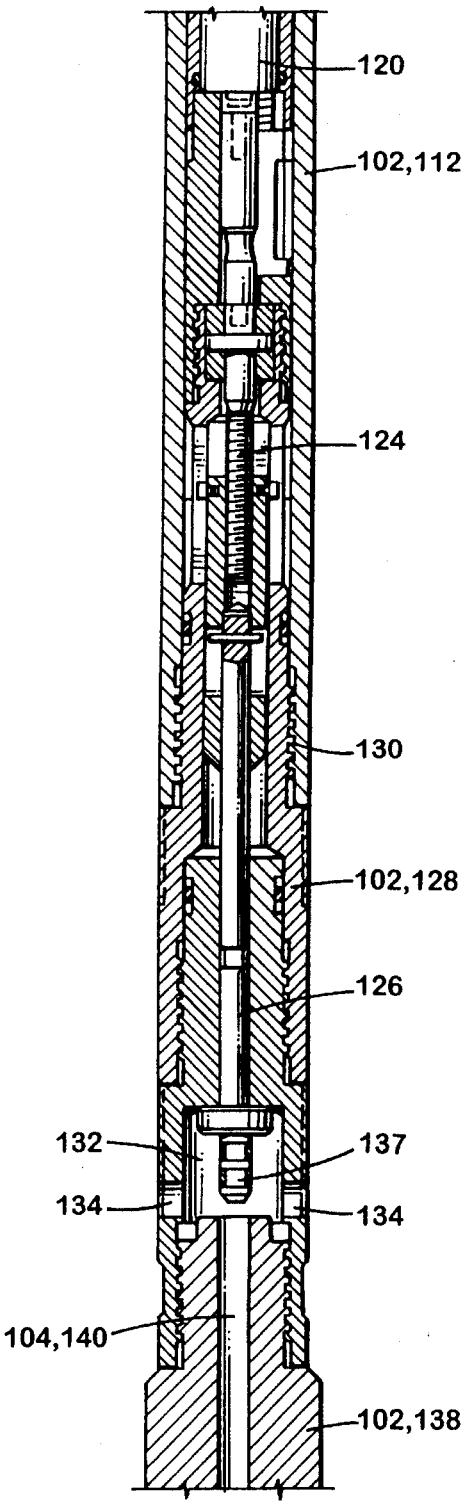
Fig. 4A
Fig. 4B
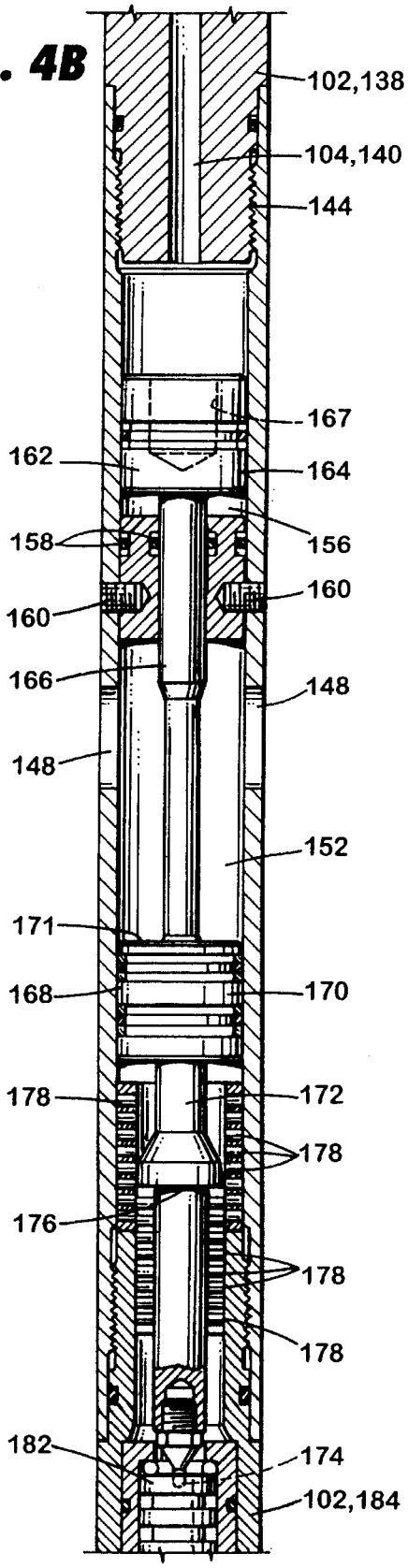

PERFORATING GUN ACTUATOR

BACKGROUND OF THE INVENTION

1. Field of the Invention

The present invention relates generally to methods and apparatus for perforating wells and particularly to actuators for actuating the firing heads of perforating guns.

2. Description of Related Art

In the completion of an oil or gas well, the casing of the well is perforated to communicate the well bore with the hydrocarbon producing formation which is intersected by the well. After the well has been drilled and cased, a perforating gun with shaped charges is lowered into the well to a location adjacent the hydrocarbon producing formation. A firing head associated with the perforating gun detonates the shaped charges which penetrate the casing thus allowing formation fluids to flow from the formation through the perforations and into the production string for flowing to the surface.

Many techniques have been used in the past to actuate perforating guns and perforate the casing. For example, perforating guns have been actuated electrically, through drop bar mechanisms, and through pressure actuation.

Historically perforating guns have been actuated electrically. The firing head and perforating gun are lowered into the well on a wireline. Electrical current is sent through the wireline to set off the firing head which in turn detonates the shaped changes in the perforating gun.

Other techniques are employed in tubing conveyed perforating systems. In such a system, the firing head and perforating gun are lowered into the well on the end of a tubing string. One method of setting off the firing head is to drop a weight through the bore of the tubing string to impact the firing head and detonate the perforating gun. Tubing conveyed perforating systems are available from the Halliburton Company, the Assignee of the present invention.

Other tubing conveyed perforating systems employ a differential firing head which is actuated by creating a pressure differential across an actuating piston in the firing head. The pressure differential is created by applying increased pressure either through the tubing string or through the annulus surrounding the tubing string to move the actuating piston in the firing head. Typically, the firing head actuating piston will have hydrostatic pressure applied across the actuating piston as the tool is run into the well. When it is desired to operate the tool, the increase in pressure is sufficiently large to initiate detonation of the firing head and perforating gun. Thus, hydrostatic pressure is on the low pressure side of the actuating piston and the increased pressure in the tubing string or annulus is on the high pressure side of the piston.

A commercially available firing head system is the VannJet® firing head and differential firing head combination manufactured and sold by the Vann Systems Division of Halliburton Company. In this system, the firing head and perforating gun are again lowered on a tubing string. This firing system includes a stinger which protrudes upwardly within the tubing string from above the differential firing head. A first explosive pathway extends from the upper end of the stinger to the firing head. The first explosive pathway includes a first booster charge, a length of primacord and a second booster charge. The VannJet® firing head is lowered through the tubing string on a wireline and received over the stinger. A pressure increase within the bore of the tubing string is applied to the VannJet® assembly causing the VannJet® actuator to initiate a percussion detonator which in turn initiates the first explosive pathway. Alternatively, the VannJet® firing head might be actuated by mechanical jarring or use of an electric timer. Methods which depend upon pressure increases transmitted down the tubing string or annulus from the surface have disadvantages. Quite often, required actuating pressures approach the pressure safety limits for surface equipment. These methods cannot be used in wells which have already been perforated since the previous perforations bleed off the increased pressure into the formation.

Further, such methods are cumbersome for perforating in an underbalanced condition, wherein the annulus pressure is lower than the formation pressure during detonation of the perforating gun. In practice, movement of the actuating piston often requires large and costly amounts of injected nitrogen to generate the needed pressure differentials. If annulus pressurization is used to initiate detonation, delay timing, using for example, pyrotechnic or electrical time delays, is necessary to allow the pressure to be bled off the annulus prior to detonation.

One technique which avoids having to pressurize the tubing string or annulus is use of an electronic timer to operate an electrically-actuated blasting cap inside the combined firing head and gun. After the gun has been placed in the well, the timer is set preset to expire after a predetermined amount of time and then lowered by slickline into the tubing string to contact the basting cap in the gun. When the timer expires, an electric current is transmitted to the blasting cap detonating it. This system poses a safety risk since the electrical blasting cap is prone to premature detonation caused by stray electricity prior to being run into the well. Also, if the gun fails to fire at the end of the predetermined amount of time, the gun cannot be safely retrieved because of the risk of a delayed detonation of the cap following removal of the gun from the well. An appropriate backup detonation system, such as those disclosed in U.S. Pat. No. 5,301,755 to George, et al. and assigned to the Halliburton Company, would have to be used to ensure detonationg of the gun.

Another technique which avoids pressurization is described in the George patent. A differential firing head is mounted on the perforating gun and lowered into the well on a tubing string. A landing nipple disposed in the tubing string above the differential firing head forms a lower tubing bore with the firing head. The differential firing head includes an actuating piston having a high pressure side communicating with the wellbore annulus through ports and a low pressure side communicating with the lower tubing bore. The annulus pressure and lower tubing bore pressure are substantially the same as the firing head and perforating gun are lowered into the well such that the pressure across the actuating piston is balanced. A firing head actuator is lowered through the tubing string and seated in the landing nipple above the differential firing head. The firing head actuator includes an atmospheric chamber with a valve for opening the atmospheric chamber to the lower tubing bore. The firing head actuator also includes an electric timer connected to a control system for opening the valve and thus exposing the atmospheric chamber to the lower tubing bore. The electric timer is preset to allow a predetermined amount of time to pass before the valve is opened. Upon opening of the valve, fluid trapped at hydrostatic pressure within the lower tubing bore is allowed to flow into the atmospheric chamber. Unbalanced pressure across the actuating piston of the firing head causes the actuating piston to move and actuate the differential firing head and perforating gun. The firing head actuator allows the well to be in an underbalanced condition during actuation since pressure increases are not used to start actuation.

In practice, hydrostatic pressures of about 2,000 psi have been required to operate the actuator of the '755 patent making the design functional in most, but not all, cases, without annulus pressurization. This hydraulic arrangement for detonation of the gun places the actuator into proximity with the perforating gun rather than creating a direct explosive pathway between the actuator and firing head. This arrangement provides a measure of safety since the actuator is not directly associated with the firing head and perforating gun charges until the actuator is placed downhole.

It would be desirable, then, to have an actuating system which is useful for detonating the gun in underbalanced and other wellbore conditions. The system should afford the relative effectiveness and certainty of systems which provide a complete explosive pathway between the actuator and the gun while maintaining the safety of proximity systems which keep the actuator separate from the gun at the surface and during emplacement. It would also be desirable to have an actuating system which did not require application of wellbore pressurization in order to operate reliably and which allows use of back up detonating systems.

SUMMARY OF THE INVENTION

The invention features an actuating tool which is conveyed into a tubing string to attach to portions of an emplaced perforating gun. The actuating tool includes an actuator with an electronic delay timer and an explosive device. The actuating tool with explosive device attaches to an emplaced perforating gun to form a complete explosive pathway between the actuator and the gun. The actuator detonates the gun by initiating an explosive charge along the explosive pathway created. Upon expiration of the timer, existing hydrostatic pressure is used to start the actuation sequence. In alternate embodiments, the timer may be started once the tool has been conveyed into the tubing string by means of a rupture disk arrangement. A tandem piston arrangement is described which improves responsiveness of the actuator to existing hydrostatic pressures. Necessary piston movement occurs entirely within the actuator and will operate at most existing hydrostatic pressures. As a result, there is little or no need to pressurize portions of the wellbore and then bleed the pressure off prior to actuation. Because the arrangement requires some hydrostatic pressure to fire the gun, the risk of premature detonation at or near the wellbore surface is minimized. In the event of a failure, the system permits the tool to be withdrawn and a backup detonation tool to be placed into the tubing string to detonate a secondary firing head.

BRIEF DESCRIPTION OF THE DRAWINGS

FIGS. 2A–D are a partial cross-sectional representation of an exemplary actuator tool 100 constructed in accordance with the present invention. The tool 100 is configured as it would appear after actuation.

FIGS. 3A–B are a partial cross-sectional representation of portions of the exemplary actuator tool 100 before actuation.

FIGS. 4A–B are a partial cross-sectional representation of the portions shown in FIGS. 3A–B as they would appear after detonation.

FIG. 8 is a detail of an exemplary rupture disk arrangement.

DETAILED DESCRIPTION OF PREFERRED EMBODIMENTS

Figure 1:
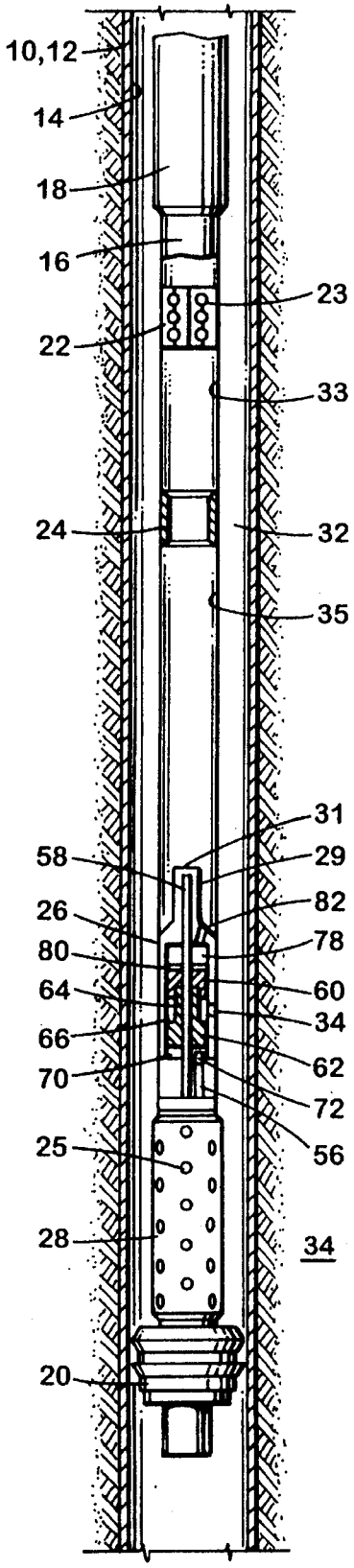
FIG. 1 is an overall schematic illustration of an exemplary tubing conveyed perforating system.
Figure 5:
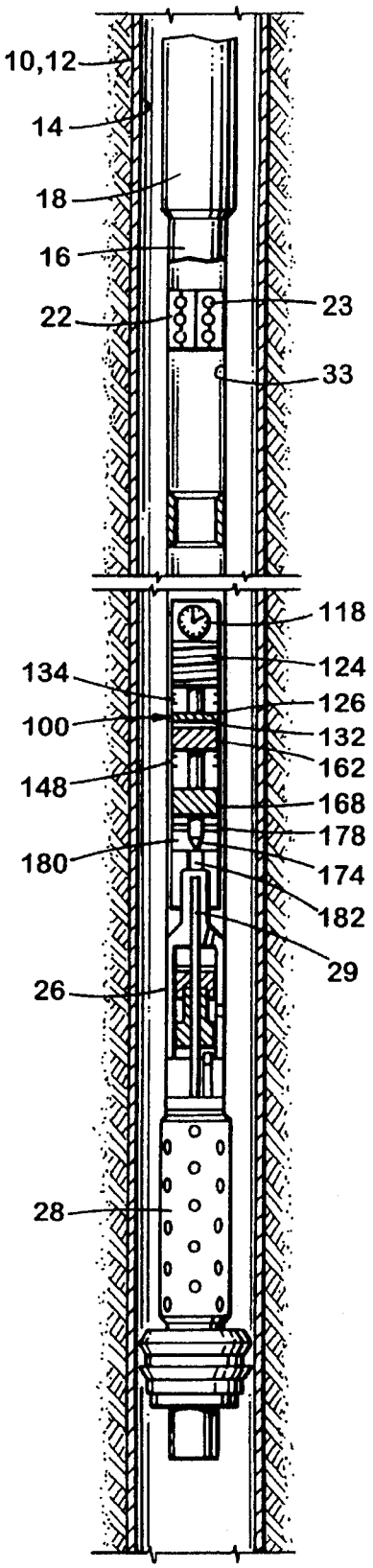
FIG. 5 is a schematic representation of an embodiment for tool 100 featuring timer actuation prior to opening of valve assembly 126.
Figures 2A, 2B, 2C:
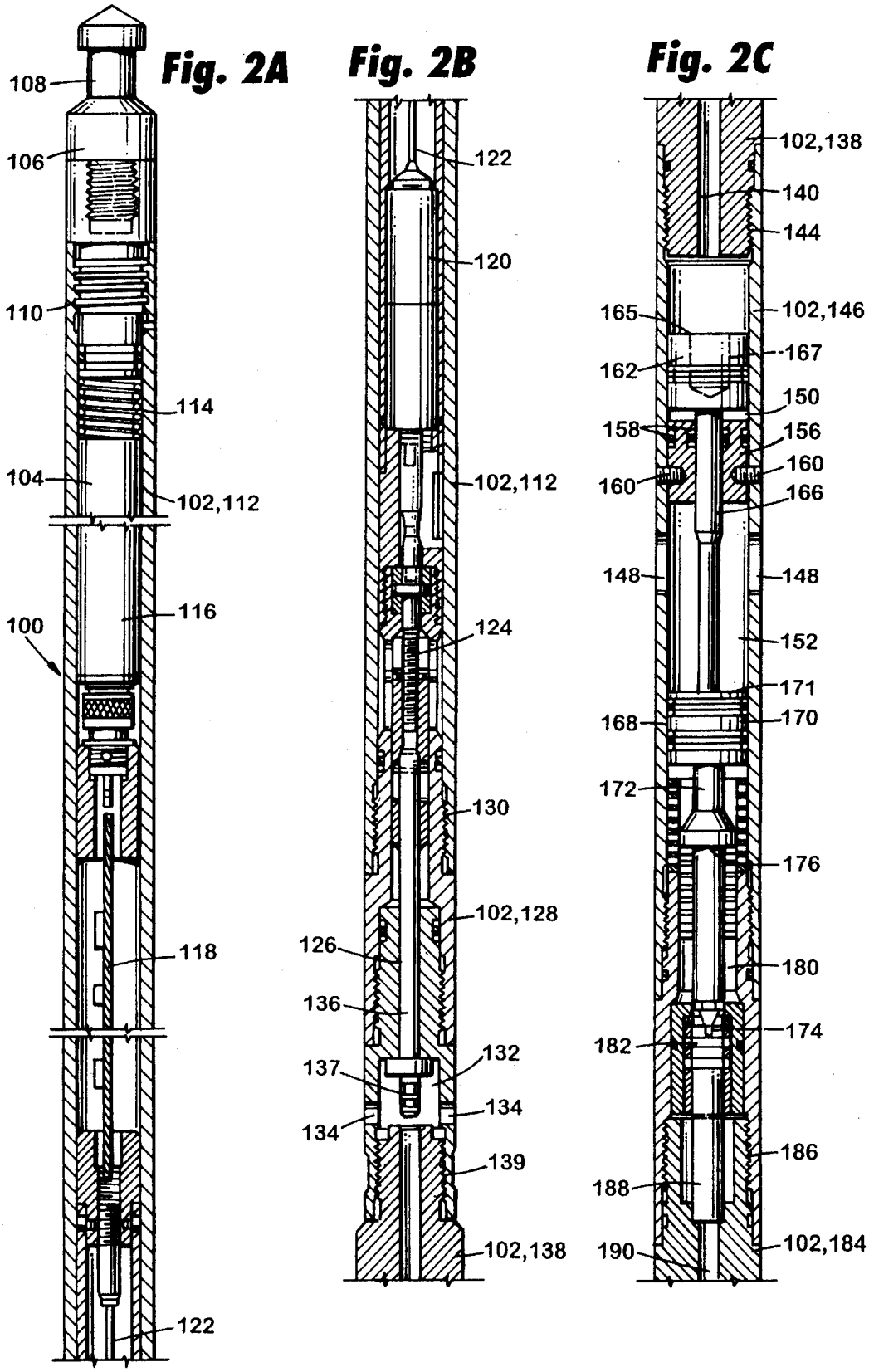
Figure 6:
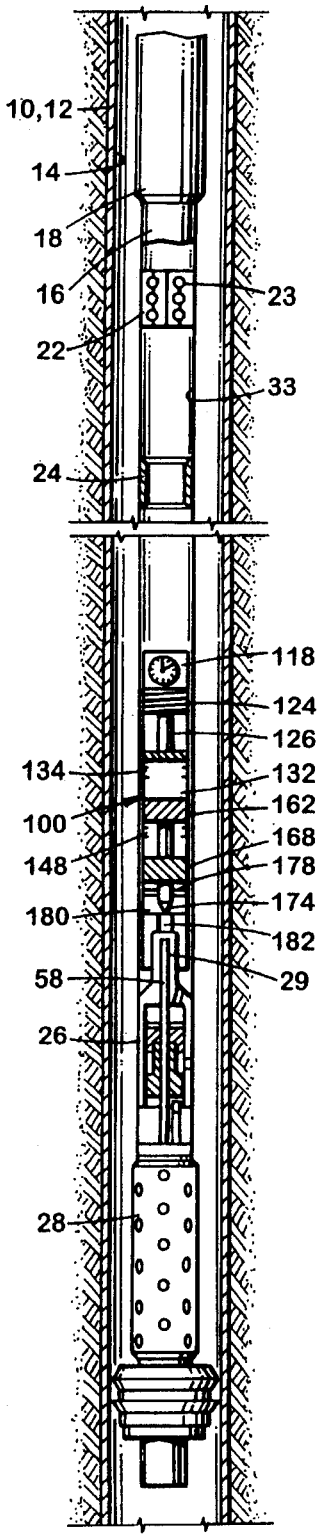
FIG. 6 is a schematic representation of an embodiment for tool 100 featuring timer actuation following opening of valve assembly 126.

As shown in FIG. 1, a well 10 is represented schematically by a well casing 12 having a wellbore or casing bore 14 defined therein. Exemplary arrangements for a tubing conveyed perforating string are briefly described by way of background, as they are generally known and understood by those skilled in the art. A portion of a tubing string 16 is shown in place within the wellbore 14 and forms an annulus 32 with the well casing 12. It will be appreciated that the tubing string 16 is lowered into the wellbore 14 from the earth's surface and the tubing string 16 will initially extend entirely to the surface of the well. In FIG. 1, only a lower portion of the tubing string 16 is illustrated. An on/off tool 18 has been disconnected from an upper tubing string portion. An auto-release gun hanger 20 may be used on the lower end of the tubing string 16 to anchor the tubing string 16 in place within the wellbore 14. This arrangement is shown by way of example only, and those skilled in the art will recognize that the gun hanger 20 may also be placed elsewhere within the tubing string with respect to associated perforating guns and firing heads. The tubing string 16 has assembled therewith a perforated nipple 22 with ports 23, a seating nipple or landing nipple 24. The landing nipple 24 divides the bore of the tubing string 16 into an upper tubing bore 33 and a lower tubing bore 35. A secondary, hydraulic differential firing head 26 and a perforating gun 28 are located above the gun hanger 20.

Referring now to FIGS. 1 and 2A–D, a retrievable firing head tool 100 is shown which includes generally a housing 102 and a bore 104 therethrough. The tool 100 is intended to be positioned within the tubing string 16 and lowered by wireline to attach to the stinger 29. The stinger 29 is preferably a VannJet® stinger, the use and operation of which is well known in the art. As is well known in the art, a first explosive pathway 58 is provided between the stinger 29 and the gun 28 which detonates downwardly and, ultimately, fires the shaped charges 25 in the gun 28. Additional details regarding the construction of this type of stinger are given in U.S. Pat. No. 5,301,755, issued to George, et al. and assigned to Halliburton. The details of that patent are herein incorporated by reference.

The differential firing head 26 includes an actuating piston 60 and a firing piston 62. Details regarding the construction and operation of the differential firing head 26 are also provided in U.S. Pat. No. 5,301,755. Firing piston 62 includes collet fingers 64 which are held in place by actuating piston 60 such that actuating piston 60 must move upwardly into upper cavity 78 to release firing piston 62. Ports 34 communicate the annulus 32 with the bore 66 located between pistons 60, 62. A lower cavity 70 is provided below firing piston 62. The differential firing head 26 may be actuated using hydraulic pressure differential and provides a second explosive pathway 56 to the perforating gun 28. A firing pin 72 projects into lower cavity 70 and is engaged with the second explosive pathway 56. As can be appreciated, first and second explosive pathways 58, 56 may include primacord. Shear pins 80 are provided to secure actuating piston 60 in position. Upper cavity 78 communicates by means of a conduit or other communication passageway 82 with the lower tubing bore 35. The actuating piston 60 includes a high pressure side communicating with bore 66 and the wellbore annulus 32 by means of ports 34. Actuating piston 60 also includes a low pressure side communicating with tubing bore 35 by means of upper cavity 78 and communication passageway 82. The pressure in annulus 32 and the pressure in the lower tubing bore 35 are substantially the same as the firing head 26 and perforating gun 28 lowered into the well 10 since well fluids may flow through the ports 23 in perforated nipple 22 causing the pressure across actuating piston 60 to be balanced.

It is noted that the construction of upper portions of tool 100 may be similar to that of the electronic self-contained timer operated firing head actuator of FIGS. 5A–5D of U.S. Pat. No. 5,301,755. Methods of disposing an actuating tool within a tubing string are also described in that reference. However, portions of that tool, where helpful, will be described briefly here to aid the reader in understanding the invention. Connections between components, although not specifically described in all instances, are shown schematically and comprise conventional connection techniques such as threading and the use of elastomeric O-ring or other seals for fluid tightness where appropriate.

Beginning at the top of the tool 100, an upper connector 106 includes a fishing neck 108 proximate its upper end for attachment by a slickline device (not shown). The upper connector is attached at threaded connection 110 to electronics housing 112 therebelow which contains a spring assembly or other shock absorber arrangement 114, battery pack 116 and electronics package 118. The electronics package 118 contains a timer or timer circuitry such as are known in the art and which may be preset to expire at the end of a predetermined amount of time. The electronics package 118 is associated with an electric motor 120 via a power cable 122.

The electric motor 120 is operably connected with a lead screw assembly 124 such that the motor 120 will operate the lead screw assembly 124 to open valve assembly 126. The open and closed configurations for valve assembly 126 may be appreciated lay comparison between FIG. 3A (valve closed) and FIG. 4A (valve open) as well as schematic FIGS. 5 (valve closed) and 6 (valve open). Valve assembly 126 includes a valve housing 128 which is affixed to the electronics housing 112 at threaded connection 130. The valve housing includes lateral ports 134 which expose chamber 132 to the tubing string or well bore 16. The lower portion of the valve housing 128 is affixed at thread 139 to connector sub 138 which encloses bore 140. A valve stem 136 is slidably disposed within the valve housing 130 and presents a sealing end 137 which is removably disposable within bore 140 to selectively permit fluid communication between fluid entering the ports 134 and the bore 140 of the connector sub 138. The bore 140 is initially closed to fluid communication and contains unpressurized air.

The lower end of the connector sub 138 is affixed at thread 144 to piston section housing 146 which contains fluid ports 148 communicating with the tubing string 16. The piston section housing 146 encloses an upper chamber 150 which, as shown in FIG. 3B, is initially filled with unpressurized air. A central chamber 152 is also initially air-filled, but due to the presence of fluid ports 148 will be filled with fluids from within the tubing string 16 or other portions of the wellbore once the tool 100 is disposed within the tubing string 16. A packing arrangement 156 separates the upper and central chambers 150 and 152 and, by virtue of seals 158, affords a generally fluid-tight seal between them. Allen screws 160 hold the packing arrangement 156 in place within the piston section housing 146.

A piston assembly including an upper piston 162 and a lower piston 168 are reciprocally disposed in housing 146. Upper piston 162 is slidably disposed within the upper chamber 150 and includes a piston head 164 with an upper side 165 and a piston stem 166 which extends downwardly therefrom through the packing arrangement 156 and into the central chamber 152 below. The enlarged upper portion 164 includes a bore 167 to reduce the weight of upper piston 162 lessening the piston's inertial resistance to movement.

A lower piston 168 is disposed within the piston section housing 146 below the fluid ports 148 and also includes a piston head 170 with an upper side 171 and a piston stem 172 extending downwardly therefrom. The lower end 169 of piston stem 166 abuts and terminates against upper side 171. The lower end of piston stem 172 terminates in a firing pin 174. The piston stem 172 also includes an annular downwardly facing shoulder 176.

An initiator 182 is threaded to the lower end of piston section housing 146. The percussion initiator 182 may be of any known construction. A suitable percussion detonator is described in U.S. Pat. No. 4,614,156, issued to Colle, Jr., et al., assigned to Halliburton Company and which is incorporated herein by reference.

The initiator includes firing pin 174 which is held in place by a set of shear pins or shear rings 178. In current models, the shear pins 178 may number between 1 and 20 to provide a shear resistance which may be set between 730 psi and 14,600 psi.

A lower chamber 180, filled with unpressurized air, is defined between the piston head 170 of the lower piston 168 and the percussion initiator 182 therebelow. A downward pressure differential exists across the lower piston 168 as a result of hydrostatic fluid entering central chamber 152 through fluid ports 148.

The hydrostatic pressure in the well communicates with the upper side 171 of lower piston 168 via fluid ports 148. Shear pins 178 provide a predetermined shear resistance to prevent the pressure from the hydrostatic head on upper side 171 to have sufficient force to shear pins 178. As previously discussed, lower chamber 180 is basically at atmospheric pressure thereby creating a pressure differential across lower piston 168 which is insufficient to shear pins 178. Upper piston 162 is housed within upper chamber 150 which is also substantially at atmospheric pressure since the valve assembly 126 is closed prior to lowering tool 100 into the well. The hydrostatic head communicating through ports 148 act upon the lower end 169 of stem 166 of upper piston 162 tending to cause piston 162 to rise within upper chamber 150. Upon opening valve assembly 126, the well fluids are allowed to pass through ports 134 and bore 140 into upper chamber 150. The pressure of the hydrostatic head acts on the upper side 165 of upper piston 162. It is noted that because the hydrostatic pressure also acts upwardly on the lower end 169 of stem 166, the effective pressure area on the upper side 165 of upper piston 162 is the area of upper side 165 less the cross-sectional area of shaft 166, i.e., the effective pressure area. The hydrostatic head acting on the effective pressure area of upper piston 162 provides an additional force via stem 166 to the upper side 171 of lower piston 168. This additional force is designed, together with the force acting on the upper side 171 of lower piston 168, to provide sufficient force to shear pins 178. Once shear pins 178 are sheared, the hydrostatic pressure acting through ports 148 cause lower piston 168 to snap downwardly forcing firing pin 174 into percussion initiator 182. The downward movement of lower piston 168 after the shearing of pins 178 occurs at a greater velocity than the downward movement of upper piston 162. The increased velocity of piston movement is advantageous as it provides greater certainty that the percussion initiator 182 will initiate properly.

By way of example and not by limitation, the area of upper side 171 of lower piston 168 and upper side 165 of upper piston 162 is 1.226 square inches. The effective pressure area of upper side 165 after subtracting the cross-sectional area of 0.196 square inches for stem 166, leaves an effective cross-sectional area of 1.030 square inches on the upper piston 162. Assuming for purposes of illustration that the hydrostatic head was 1,000 psi, the force supported by the shear pins on the lower piston 168 would be 1,226 lbs. The shear pins 178, for example, would provide a shear resistance of approximately 1,600 lbs. Upon opening valve assembly 126, the 1,000 psi hydrostatic head would also act on the effective pressure area of upper piston 162 which would add an additional 1,030 pounds of force. Combined, upper and lower pistons 162, 168 would provide a force of 2,256 lbs which would be greater than the shear resistance of shear pins 178 thus shearing pins 178. The greatly increased downward force upon the upper piston 162 causes the lower piston 168 to snap downwardly to actuate firing pin 174.

Because the forces generated by the two pistons are additive, smaller components may be used to generate the necessary shear forces. Consequently, the tandem piston assembly of the present invention has the advantage that motor 120 may be of limited size and still have sufficient power to operate the lead screw assembly 124 and open the valve assembly 126. The hydrostatic pressure through ports 134 acts upon the valve stem 136 and sealing end 137 creates friction against the cylindrical wall forming bore 140. The frictional engagement of sealing end 137 together with the hydrostatic head acting on stem 136 determines the size of electric motor 120 required to operate lead screw assembly 124 and open valve assembly 126. The larger the diameter of bore 140, the greater the friction of sealing end 137 and the greater the cross-section of stem 136. If the tandem pistons were to be eliminated and pressure was instead applied to a single pinned piston, an enlarged diameter bore 140 would likely be required to provide sufficient fluid volume upon the single piston to move that piston with adequate force and velocity to assure effective operation of the percussion initiator 182. The size requirements for the electrical motor 120 to operate lead screw assembly 124 and open valve assembly 126 would increase substantially. Using the tandem piston arrangement described, a smaller motor suffices for operation because a smaller bore fluid path 140 provides for placement of adequate fluid pressure upon upper piston 162 to ensure that its downward movement is effective in helping to shear pins 178. The presence of open ports 148, which are preferably larger in diameter than the fluid path of bore 140, permit the upper side of the lower piston 168 to be subjected to hydrostatic pressure while the tool 100 is within the well. Once pins 178 have sheared, the fluid volume and hydrostatic pressure from ports 148 assists in supplying sufficient downward force and velocity upon the lower piston 168 to aid it in effectively operating the percussion initiator 182.

An explosives section housing 184 is affixed at thread 186 to the lower end of the housing of the initiator 182 and maintains a first booster charge 188 proximate the percussion initiator 182. A length of primacord 190 connects the first booster charge 188 to a second booster charge 192 proximate the lower end of the explosives section housing 184. A downwardly directed shaped charge 194 is associated with the second booster charge 192. The percussion initiator 182, primacord 190, booster charges 188 and 192, and shaped charge 194 may be collectively thought of as an explosive device operably associated with the timer of the electronics package 118 for initiation following the expiration of a preset amount of time. Threaded below the shaped charge 194 is a colleted connector 196 which is fashioned to be complimentary to the profile of stinger 29. If detonated with the colleted connector 196 attached to the stinger 29, the shaped charge 194 will detonate downwardly into the stinger 29 and initiate the first explosive pathway 58 contained therein.

Operation of the Tool 100

Referring again to FIG. 1, the tubing string 16 is assembled with an on/off tool 18, a perforated nipple 22, a landing nipple 24, a differential firing head 26, a perforating gun 28, and exemplary auto release gun hanger 20. The tubing string 16 with the perforating system attached is lowered into the casing string 16 with the gun hanger 20 anchoring the tubing string 16 in place within the wellbore 14 so as to position the perforating gun 28 adjacent the producing zone 34 to be perforated.

Referring now to FIGS. 3–6, there are shown methods of operation of firing tool 100 for the actuation of firing head 26 and perforating gun 28. Prior to lowering the firing tool 100 into the well 10, the electronic timer of electronics package 118 is set and started at the surface. A predetermined amount of time is set on the electronic timer to provide adequate time for the tool 100 to be lowered into the well, to be properly latched onto the stinger 29 and to disconnect and retrieve the wireline. After setting and starting the electronic timer of electronics package 118, the tool 100 is lowered into the bore of tubing string 16 on a wireline (not shown). The tool 100 is essentially lowered and latched onto stinger 29. Upon properly latching tool 100 onto stinger 29, the wireline is retrieved.

Once the tool 100 has been landed and the timer expires, the actuation sequence will begin. FIGS. 3 and 4 illustrate the configuration of components within tool 100 before and after actuation, and comparison between the two figures, together with the diagrams of FIGS. 5 and 6, will aid in the understanding of the actuation sequence. Once the electronic timer of electronics package 118 expires, motor 120 operates lead screw assembly 124 to open valve assembly 126. Hydrostatic pressure within the tubing string 16 and/or lower annulus enters the chamber 132, bore 140 and bore 167 through ports 134. A downward pressure differential is generated across the upper piston 162 by the fluid pressure at the upper side 165 to generate a downward axial force on the piston stem 166 to the lower piston 168. The shear pins 178 are sheared, permitting the upper and lower pistons 162, 168 to move rapidly downwardly within the piston section housing 146.

The tandem piston arrangement of upper piston 162 and lower piston 168 aids in effecting actuation at existing tubing string or lower annulus pressures. The shear pins 178 will not shear at atmospheric pressures. The shearing actually results from a combination of fluid pressure at the upper side 171 of lower piston 168 and the axial force applied to the upper side 171 by the piston stem 166 of the upper piston 162. Although some hydrostatic pressure will be needed, the actuation sequence described should function properly in response to pressures generated by the normal hydrostatic head within a tubing string in an underbalanced condition. There is, therefore, little or no need to pressurize portions of the annulus to initiate actuation. In current models, the tandem piston arrangement will function at hydrostatic pressure levels of as little as 500 psi. The maximum recommended pressure level is around 12,000 psi for these models.

Figure 7:
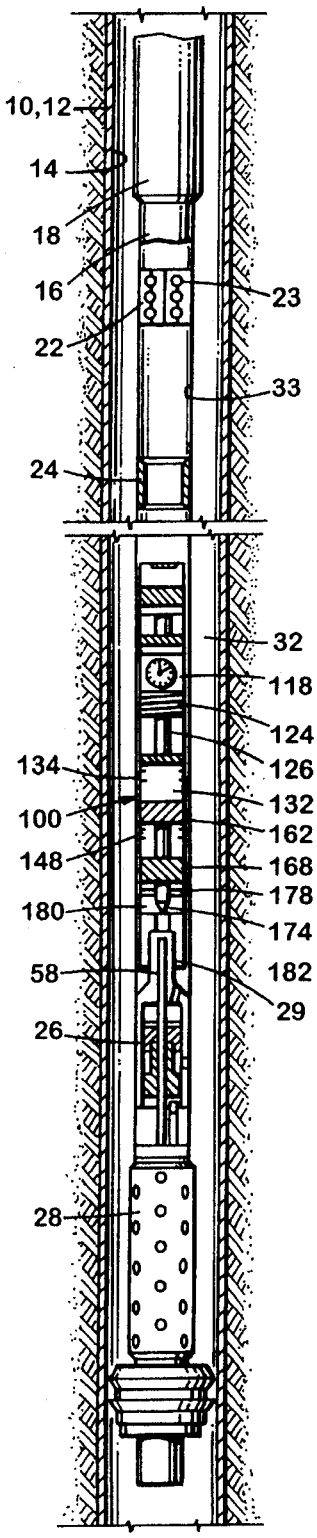
FIG. 7 is a schematic representation of an alternative embodiment for tool 100 incorporating a rupture disk arrangement.

Downward movement of the lower piston 168 causes the firing pin 174 to impact the percussion initiator 182. The impact detonates the initiator 182, first booster charge 188, primacord 190, second booster charge 192 and shaped charge 194. It is noted that a complete explosive pathway will be formed between the actuator of tool 100 and the perforating gun 28. This pathway includes the percussion initiator 182, first and second booster charges 188 and 192, primacord 190, shaped charge 194 and the first explosive pathway 58 within the stinger 29. Referring now to FIGS. 7 and 8, there is shown schematically alternative means for starting the timer of the electronics package 118. In the preferred embodiment, the timer is set at the surface to operate electric motor 120 after a predetermined period of time. The alternative embodiment shown in FIGS. 7 and 8 allow the tool 100 to be conveyed into the tubing string 16 and attached to the stinger 29 before starting the timer in the electronics package 118. Referring to FIG. 8, there is shown a starter means 200 which is threaded to the upper end of electronics housing 112. Starter means 200 includes a connector sub 202 threaded at 204 to the upper end of housing 112. The upper connector 206 of the preferred embodiment is mounted on top of the starter means 200 and includes a fishing neck 208 at its upper end for attachment by a slickline device (not shown). Upper connector 206 threadedly engages the upper end of connector sub 202 at 210. Upper connector 206 includes a cylindrical bore 212 in which is disposed a floating piston 214. A fluid passageway 216 communicates with the upper side of floating piston 214 with a transverse bore 218 extending to the annulus 32. A rupture disk 220 is disposed in bore 218. A silicone fluid is disposed in bore 212 below floating piston 214. Connector sub 202 includes an axial bore 222 which extends its length. A fluid retarding member 224, such as a visco jet, is disposed at the upper end of axial bore 222 and communicates with the bore 212 below floating piston 214. A grounding piston 230 is disposed in the lower end of connector sub 222 and upper end of housing 112. Grounding piston 230 is held in place by shear pins 226. The upper end of grounding piston 230 is exposed to axial bore 222.

To operate the starter means 200, the bore of tubing string is pressurized sufficiently to cause rupture disk 220 to burst. The well fluids in annulus 32 will enter transverse bore 218, passageway 216 and into the upper portion of bore 212. The hydrostatic head acts downwardly on the upper side of floating piston 214 causing it to move downwardly within cylinder 212. This downward movement forces the silicone fluid through the fluid retardation member 214. Fluid retardation member 214 includes a tortuous passageway slowing the passage of the silicone fluid from bore 212 into axial bore 222. As the pressure builds within axial bore 222, the pressure reaches a predetermined limit so as to shear pins 226. Upon shearing pins 226, grounding piston 230 moves downwardly to engage the upper ends of the battery pack 116. Upon grounding piston 230 engaging battery pack 116, a circuit is completed in the electronics package 118 thereby actuating the timer in electronics package 118.

The visco jet is a well-known device for fluid restriction. If visco jet 224 were not used, upon bursting rupture disk 220, the hydrostatic pressure would cause the rapid downward movement of grounding piston 230 versus allowing the fluid to meter through axial bore 222 and ease grounding piston 230 into electrical contact with the upper end of battery pack 116.

Figure 9:
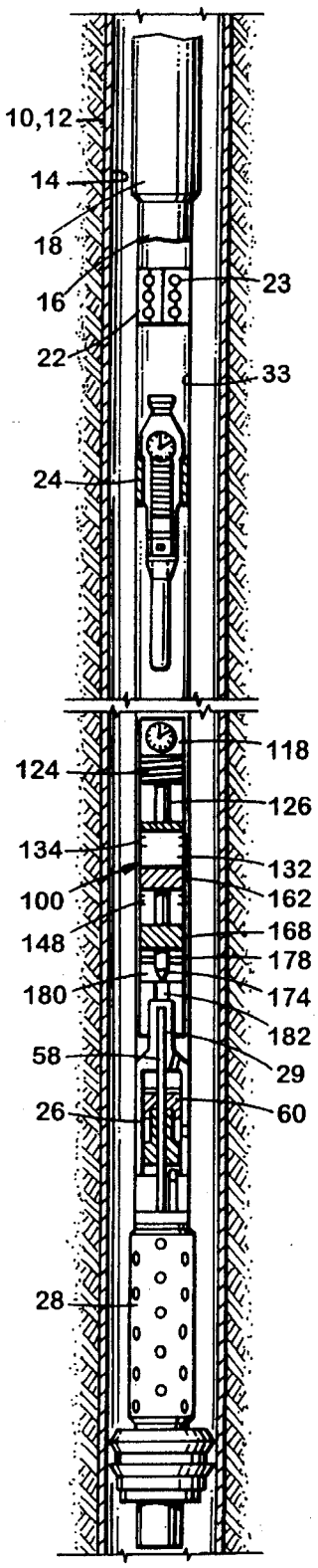
FIG. 9 is a schematic representation showing the tool 100 and one possible backup actuator.

Referring now to FIG. 9, in the event that the tool 100 cannot be properly latched onto stinger 29 such as due to debris in the tubing string 16, or should the mechanism of tool 100 fail to operate, an air chamber actuator such as that shown and described in U.S. Pat. No. 5,301,755 may be lowered into the tubing string 16 and seated in landing nipple 24. Upon the expiration of the time on the electric timer, the screw mechanism will open the valve assembly and create a low pressure area in the lower tubular bore 35 such that actuating piston 60 in firing head 26 becomes unbalanced and the differential pressure across actuating piston 60 actuates firing piston 62 to thereby actuate firing head 26 as previously described. If tool 100 does not operate successfully, tool 100 may be withdrawn from the tubing string 16 and another method of detonation employed.

While the invention has been described with respect to certain preferred embodiments, it should be apparent to those skilled in the art that it is not so limited. The construction, shape; and arrangement of components may be varied, for example. Various other modifications may be made without departing from the spirit and scope of the invention.

What is claimed is:

1. An actuator for actuating a perforating gun, comprising:

a. a housing having at least one port extending through the wall of said housing;

b. a presettable timer mounted within said housing and expiring following a preset amount of time;

c. a piston assembly reciprocally mounted within said housing and reciprocally moveable within the housing upon expiration of said preset amount of time;

d. a valve opening said port to said piston assembly upon the expiration of said preset amount of time;

e. an explosive disposed within said housing and detonated upon the movement of said piston assembly due to the expiration of said preset amount of time to initiate the actuation of the perforating gun.

2. The actuator of claim 1 wherein said piston assembly includes:

a. a first piston slidably disposed within said housing, said first piston having a pressure receiving side and a working side operable to apply an axial force as pressure is received from said port at the pressure receiving side, said first piston being moveable within the housing in response to fluid pressure from said port at the pressure receiving side;

c. a second piston slidably disposed within said housing, said second piston having a pressure receiving side and a working side and said second piston being moveable within said housing in response to fluid pressure at the pressure receiving side and axial force applied to the pressure receiving side by said first piston, 3. The actuator of claim 2 further comprising an atmospheric chamber within said housing in selective communication with said piston assembly for movement of said piston assembly.

4. The actuator of claim 1 wherein said explosive device includes a shaped charge.

5. The actuator of claim 4 wherein the explosive device is operable to detonate downwardly to initiate detonation of an explosive path within the tubing conveyed perforating gun firing head.

6. An actuator for a perforating gun within a wellbore, said actuator comprising:

a. a housing;

b. an atmospheric chamber within the housing;

c. a valve permitting selective fluid communication between the atmospheric chamber and a wellbore to allow the chamber to become filled with a well fluid from the wellbore;

d. a piston slidably disposed within the housing and in selective communication with the chamber for movement within the housing as the chamber fills with a fluid; and e. an explosive charge actuated upon said piston moving within the housing.

7. The actuator of claim 6 wherein the piston is moveable within the housing in response to hydrostatic pressure within a wellbore of around 500 psi or greater.

8. A piston assembly for placement in a wellbore tubing string and responsive to hydrostatic pressure within the tubing string, the piston assembly comprising:

a. a piston housing;

b. a first piston slidably disposed within the piston housing, the first piston having pressure receiving side and a working side operable to apply an axial force as pressure is received at the pressure receiving side, the first piston being moveable within the housing in response to fluid pressure at the pressure receiving side;

c. a second piston slidably disposed within the piston housing, the second piston having a pressure receiving side and a working side, said first piston contacting the second piston upon its pressure receiving side and said second piston being moveable within the housing in response to fluid pressure at the pressure receiving side and axial force applied to the pressure receiving side by said first piston; and d. means for selectively establishing fluid communication between the pressure receiving sides of the first and second pistons and a tubing string.

9. The piston assembly of claim 8 wherein the means for selectively establishing fluid communication between the pressure receiving sides of the first and second piston and a wellbore comprises an atmospheric chamber within the actuator and a valve selectively permitting fluid communication between the chamber and a wellbore to allow the chamber to become filled with a well fluid from a wellbore.

10. The piston assembly of claim 9 wherein the first piston includes an enlarged upper portion having a downwardly extending piston stem for contacting the pressure receiving side of the second piston.

11. The piston assembly of claim 10 wherein the second piston is engaged with the housing by shear members operable to shear in response to a predetermined amount of pressure and axial force upon the pressure receiving side of the second piston.

12. The piston assembly of claim 11 wherein the first and second pistons are moveable within the housing in response to hydrostatic pressure of around 500 psi or greater.

13. A method of firing a perforating apparatus suspended within a well, comprising the steps:

a. presetting a timer in an actuator;

b. opening at least one port in the actuator upon expiration of the timer;

c. communicating well fluids through the port to a piston member in the actuator;

d. moving the piston member;

e. actuating an initiator upon the movement of the piston; and f. detonating the perforating apparatus upon actuating the initiator.

14. The method of claim 13 wherein the timer is preset and started prior to disposing the actuator within the well.

15. The method of claim 13 wherein the timer is preset prior to disposing the actuator within the well and started after disposing the actuator within the well.

16. The method of claim 15 wherein the timer is started by a pressure increase within the well which activates a starter means.

17. A method of actuating a perforating apparatus suspended within a well, comprising the steps of:

a. presetting a timer in a first actuator;

b. disposing the first actuator having an explosive device within the well to contact a stinger proximate the perforating apparatus;

c. detonating the explosive device upon expiration of the timer to attempt actuation of the perforating apparatus;

d. if attempted actuation of the initiator fails, withdrawing the first actuator from the well;

g. disposing a second actuator within the well to detonate the perforating apparatus.

18. The method of claim 17 wherein the second actuator comprises an air chamber actuator.

* * * * *